US007293323B1

(12) United States Patent
Hoce

(10) Patent No.: US 7,293,323 B1
(45) Date of Patent: Nov. 13, 2007

(54) CORDLESS SAFETY VACUUM

(76) Inventor: John Hoce, 3499 NW. 97 Blvd., Unit 3, Gainesville, FL (US) 32606

( * ) Notice: Subject to any disclaimer, the term of this patent is extended or adjusted under 35 U.S.C. 154(b) by 614 days.

(21) Appl. No.: 10/684,002

(22) Filed: Oct. 14, 2003

Related U.S. Application Data

(60) Provisional application No. 60/489,127, filed on Jul. 21, 2003.

(51) Int. Cl.
*A47L 7/00* (2006.01)

(52) U.S. Cl. ..... 15/321; 15/353; 15/49.1

(58) Field of Classification Search ..... None
See application file for complete search history.

(56) References Cited

U.S. PATENT DOCUMENTS

| | | | | |
|---|---|---|---|---|
| 3,570,222 | A | 3/1971 | Dudek et al. | |
| 4,123,818 | A | 11/1978 | Hurwitz | |
| 4,216,563 | A * | 8/1980 | Cyphert | 15/321 |
| 4,226,000 | A | 10/1980 | Tribolet | |
| 5,108,471 | A | 4/1992 | Poborsky | |
| 5,168,599 | A | 12/1992 | Williams | |
| 5,189,755 | A | 3/1993 | Yonkers et al. | |
| 5,192,344 | A | 3/1993 | House | |
| 5,287,587 | A | 2/1994 | Yonkers et al. | |
| 5,287,589 | A | 2/1994 | Hughes | |
| 5,301,388 | A | 4/1994 | Zeren | |
| 5,369,838 | A * | 12/1994 | Wood et al. | 15/320 |
| 5,504,969 | A * | 4/1996 | Beryozkin et al. | 15/320 |
| 5,846,334 | A | 12/1998 | Hoce | |
| 5,970,572 | A | 10/1999 | Thomas | |
| 6,065,182 | A | 5/2000 | Wright et al. | |
| 6,206,980 | B1 * | 3/2001 | Robinson | 134/21 |
| 6,530,117 | B2 * | 3/2003 | Peterson | 15/353 |
| 6,997,395 | B2 * | 2/2006 | Kawamoto | 239/302 |
| 2005/0005389 | A1 * | 1/2005 | Rau et al. | 15/320 |

* cited by examiner

*Primary Examiner*—David Redding
(74) *Attorney, Agent, or Firm*—Sven W. Hanson

(57) ABSTRACT

A manual operated and battery powered device is provided for complete removal of liquid spills by use of both vacuum and blow-drying. The device provides a wheeled cart including a liquid-tight pan on which are retained one or move waste liquid receivers. An electric motor powered blower within an enclosure provides both suction and blown air through attached flexible hoses. In operation, the blower creates a vacuum in the receiver which, through the flexible hoses, is used to suction waste material from a working surface. The waste material is captured in the receiver. The device is small to reduce interference with surrounding activities. The design enables cordless operation with convenient recharging from standard electrical power sources during non-operational periods.

8 Claims, 5 Drawing Sheets

CORDLESS SAFETY VACUUM

RELATED APPLICATIONS

This application claims priority from the U.S. Provisional application 60/489,127 filed on Jul. 21, 2003 in the name of John Hoce and entitled "Safety Vacuum".

BACKGROUND OF THE INVENTION

The present invention pertains to devices and methods for removing liquids from floors and similar surfaces. In particular, the invention pertains to vacuum devices with capacity for removing waste liquids from floors and walls and drying such surfaces.

In a great variety of public and private places, the accidental or incidental deposit of liquids on floors and walls often creates a safety hazard to persons walking or working in the area. The hazard may come from an inherent property of the liquid, or a mixed matter, such as flammable or poisonous or noxious materials. Recognition of this hazard element has been heightened in recent times by the increased exposure risks in health care environments from patients suffering from Human Immunodeficiency Virus and like conditions which may be spread through body wastes. The nature of these risks requires efficient and thorough waste liquid removal and cleaning methods applicable to both floors and walls and similar hard surfaces.

The hazard from liquid deposits may also come from the increased risk of slip-and-fall events by those walking on liquid. The high cost, both to industries and the general economy, as well as to the many individuals involved, from the large number of slip-and-fall accidents is well documented.

As a result of the need to remove spilled liquid hazards and decontaminate surfaces, a great number of devices have been developed to address the problem. Industrial and consumer vacuums capable of lifting and removing liquids are available in a great number of designs. The majority of these are electric powered from local alternating electric current sources requiring lengthy electrical power cords. These cords themselves are problematic as creating an additional hazard to persons who may entangle their feet in the cord when walking over it.

An additional deficiency of the prior devices that utilize vacuum suction alone to remove liquids is that inevitably a thin film of liquid remains that cannot be removed from the surface by suction alone. The liquid remaining in this film may still create a slippery low friction area potentially inducing a fall by persons walking over. This remaining film creates a potentially greater hazard to persons who, seeing or knowing of the vacuum removal, believe a liquid induced slip is no longer a risk.

Most vacuum cleaning devices include widened inlet heads to allow coverage of larger areas. On larger devices, particularly those that are motor driven, the inlet heads are rigidly attached to address a horizontal surface such as a floor. Such a configuration is incapable of cleaning vertical surfaces such as walls as must be addressed in health care facilities.

For use in public areas, large, noisy or unsightly cleaning devices are not practical. Such devices detract from the inviting appearance that is desired in stores, particularly consumer department stores. Large or unsightly devices, and devices requiring long power cords, are not desirable in high public traffic areas such as the main entrances of department stores that are most likely to suffer slippery floors due to rain water brought in by shoppers. For similar reasons, a large or unwieldy device is less likely to be used.

What is needed is a simple device capable of removing spilled liquids and completely drying the affected area. Preferably, the device should be operable on both horizontal and vertical surfaces, including elevated surfaces. Such a device should be capable of handling hazardous wastes such as body fluids in a controlled manner to safeguard the user from contact. Finally, the cleaning device should be portable and easy to use, and unintrusive, and not introduce additional hazards to the work area.

SUMMARY OF THE INVENTION

The present invention is a manually operated and manually moved device for complete removal of liquid spills by use of both vacuum and blow-drying. The device provides a wheeled cart including a liquid-tight pan on which are retained one or move waste liquid receivers. Each receiver is preferably in the form of a typically shaped plastic bucket. The pan is attached to an enclosure that provides portable battery powered suction and blown-air drying functions. An electric motor powered blower within the enclosure provides both suction and blown air through attached flexible hoses. Each receiver bucket includes an outlet connected to the blower inlet and an receiver inlet connected to a flexible suction hose. Most preferably, the receiver bucket inlet and outlet are formed in the removable lid. In operation, the blower creates a vacuum in the receiver which, through the flexible hoses, is used to suction waste material from a working surface. The waste material is captured in the receiver. The slightly warmed air is blown out blower hoses to dry any remaining liquid film on the working surface.

The enclosure also houses a battery charger and ancillary electrical components such as a manual power and charging switch. The blower motor power is provided by one or more deep-cycle rechargeable batteries within the enclosure that enable the device to operate in a variety of locations without connection to separate power sources. The device is small to reduce interference with surrounding activities. The design enables cordless operation with convenient recharging from standard electrical power sources during non-operational periods.

In an alternative embodiment, a liquid such as a cleaning agent is stored in a container. An electrically powered pump withdraws the liquid and through hoses to a dispensing head adjacent the vacuum head. In this manner, waste material may be more efficiently and thorough removed while limiting the exposure of the cleaning agent and waste to the surrounding environment. Additional elements and advantages of the invention will become apparent from the following details of the preferred embodiments and the accompanying figures.

DESCRIPTION OF THE PREFERRED EMBODIMENTS

Figure 1:
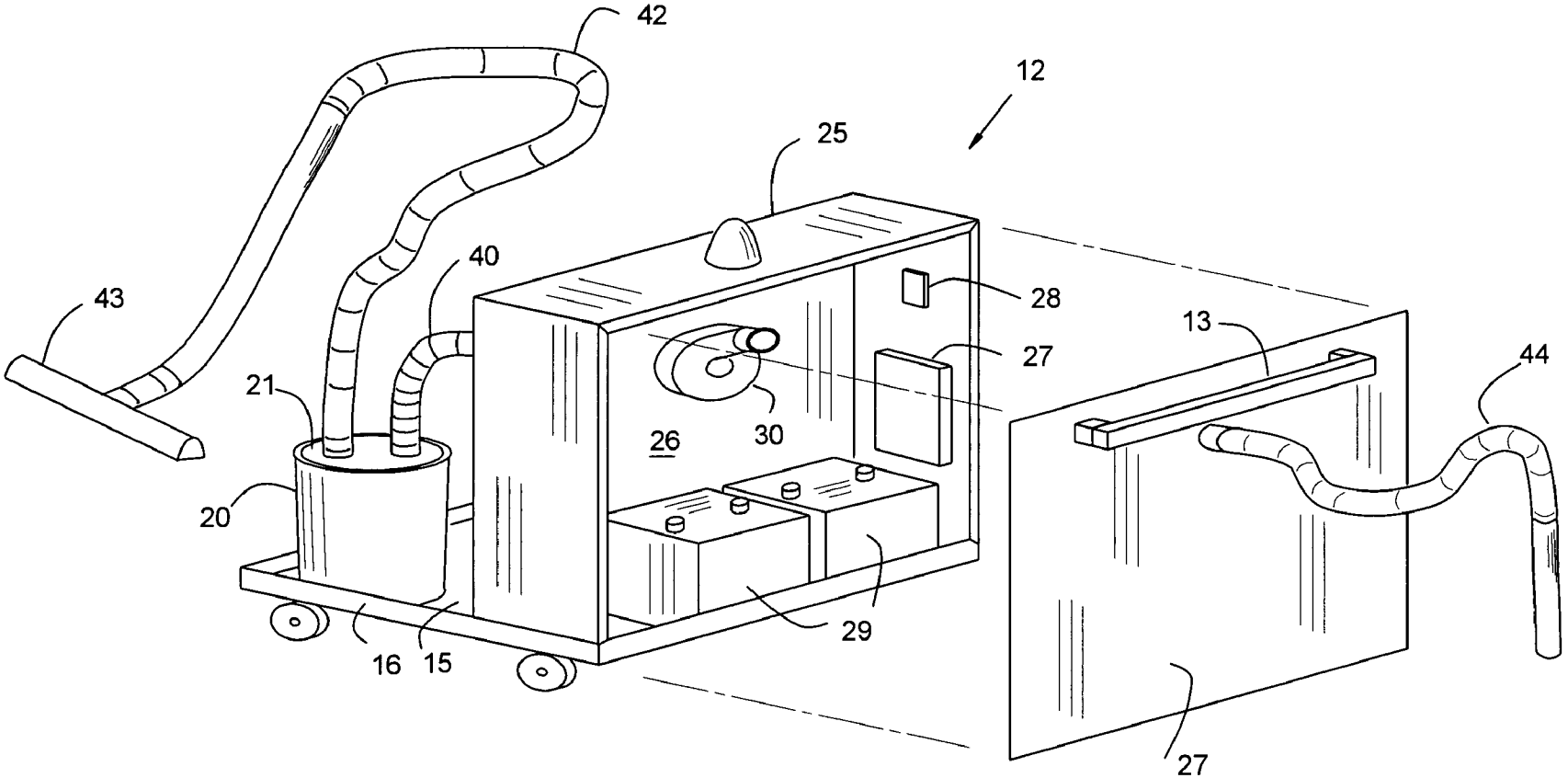
FIGS. 1 and 2 depict, in perspective views, one embodiment of the invention.
Figure 2:
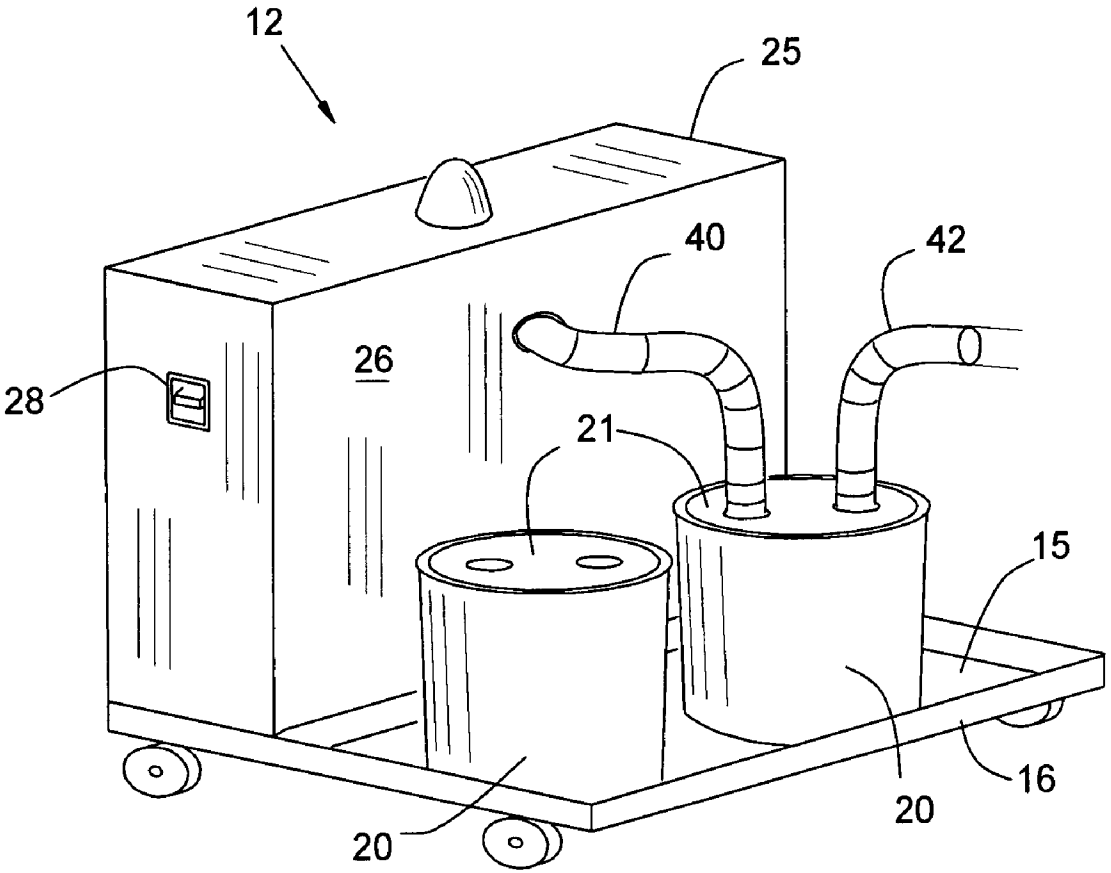

FIGS. 1 and 2 illustrate a preferred embodiment of the invention. The two figures are perspective views of opposite ends of the same device. A wheeled cart body 12 is configured to be easily moved and handled by use of a grab rail 13 that is preferably about at a height of 33 to 36 inches from the surface on which the cart 12 sits. The cart includes a open horizontal pan 15 having upturned vertical sides 16. The function of the pan 15 and sides 16 is to provide a means of supporting and retaining one or more waste liquid receivers 20. The pan 15 should be liquid-tight to prevent leaking of any liquids captured in the pan. Preferably, the pan 15 is formed of thin sheet stainless steel of 11 gauge, bent and welded tightly to form the sides 16. Preferably, the height of the sides 16 is at least one inch and preferably in the range of 1 to 2 inches.

The pan 15 extends as an integrated part of, or is connected to, a rigid enclosure 25. The function of the enclosure is primarily to provide support and protection to the powered and powering elements of the cleaning system. The construction of the enclosure is preferably of bent and welded stainless steel sheet, although other materials are contemplated. Mounted inside the enclosure 25 is an electric motor powered vacuum-blower 30. The blower 30 inlet penetrates a front wall 26 of the enclosure 25 with connection elements for connecting a vacuum transfer hose 40. The connection elements may be in the form of threaded or quarter-turn connection, or like devices, preferably with a watertight seal. The enclosure 25 also contains and protects a battery recharger 27 and switch 28. At the bottom of the enclosure are two rechargeable batteries 29. The associated electrical connections (also enclosed) between the recharger, switch, blower and batteries are not shown in the interest of clarity. The design and manner of these connections to obtain the desired functions and operation described herein are generally known and should follow existing standards in the industry. While the present device may be constructed without a charger, relying on an external charger, convenience and portability is significantly improved with the configuration shown. Preferably, the size of the combined enclosure and pan provides a conveniently configured cart which is easily moved by a single person and positioned without disrupting a workspace. The embodiment shown has a generally rectangular geometry, in horizontal plan, with relative orthogonal width and length dimensions of 24 and 26 inches.

In the embodiment shown each receiver 20 is a plastic bucket with an inside volume in the range of 5 to 10 gallons. This size range enables them to be manually carried by a user from the cart 12 when full, to be emptied. Preferably the receiver 20 is formed of a plastic that is compatible with handling hazardous wastes such as human body waste liquids and solvents. Alternatively, the receiver 20 may be formed of other inert structural materials such as stainless steel. In all configurations, the receiver 20 should be removable from the cart, or include a removable insert, to enable periodic of removal of collected waste liquid.

Each bucket configured receiver 20 includes a recoverable and replaceable watertight top 21 closing the receiver 20. Removal of the top 21 may be by any of many known mechanisms such as a threaded connection with a seal element. In the embodiment shown, the top 21 includes an inlet and outlet with respective means of connecting inlet and outlet hoses. In use, when emptying a receiver 20, the hoses are disconnected from the top 21 before moving the receiver 20. Preferably, both the inlet and outlet of each receiver include a ball-check valve to prevent accidental spills and to prevent overfilling of the receiver 20. Such valves for this purpose are known in the industry. In alternative embodiments, the inlet and outlet may be integral to the main body of the receiver or otherwise configured to enable the functions of transport of wastes into the receiver 20 and transport of air out.

Connected to the inlet of the actively connected receiver 20 in the figures is an elongated vacuum suction hose 42. The vacuum suction hose may terminate in a rigid extension of stainless tube for convenience. Preferably, at the termination of either the vacuum suction hose, or any such extension, a suction head 43 is provided. The suction head is typical of those provided with prior art devices for liquid suction removal. Preferably, the suction head 43 includes downward directed flexible "lips" of rubber or other resilient and nonabsorbent materials that are typically used to direct and squeeze liquid along a flat surface for removal. The combined action of the squeezing lips and suction is capable of removing all but a thin film of most liquid wastes. Both the vacuum transfer hose 40 and the vacuum suction hose are formed of flexible wire reinforced plastic such as is typically used for liquid suction devices. The length of the suction hose 42 and any extension, from the receiver to the head, should be at least 72 inches to enable easily addressing both horizontal and vertical surfaces.

The blower outlet is directed through a vertical back wall 27 which is shown separated from the enclosure 25 in FIG. 1. Attached to the blower outlet on the outside of the back wall 27 is a blower hose 44. Preferably, the blower hose is detachable for easy storage. The blower hose 44 may terminate in a rigid extension for convenience. The length of the hose and any extension should be at least 72 inches to easily access vertical and horizontal surfaces.

In operation, the blower 30 is powered by the batteries 29 to produce a suction effect in the vacuum transfer hose 40, this produces a vacuum or suction effect in the receiver 20, and consequently at the terminal end of the vacuum suction hose 42. The suction effect induces liquid, and light solids, on a working surface adjacent the suction hose terminal end into the hose and then the receiver 20. These wastes are generally entrained with drawn air. Due to the reduced velocity within the receiver, and gravity, liquid and solids are deposited and remain in the receiver and do not enter the blower nor exit the blower hose. The entrained air is sucked through the transfer hose 40 through the blower to the blower hose 44. Optionally, a filter or moisture separator may be added within the receiver, or otherwise, to ensure complete capture of waste matter or liquid droplets.

The passage through the blower slightly heats the air and thereby also reduces the air's relative humidity. After the bulk of liquid matter is removed from the working surface by the suction effect, typically a thin film of liquid may remain due to surface tension. This film must be removed to fully eliminate the hazard. To accomplish this, the blower hose 44 is directed at the working surface, either simultaneous with suction, or subsequent to suction removal. The high velocity and slightly warmed air emitted from the blower hose 44 will rapidly dry most liquid wastes. Due to the flexibility and length of vacuum suction hose 42 and blower hose 44, this process may be directed to a variety of working surfaces, including horizontal and vertical wall surfaces. For this reason, preferably, the length dimensions of the vacuum suction hose 42 and blower hose 44 are respectively in the ranges of 72 to 96 inches and 60 to 72 inches.

To provide the desired suction functions, the blower 30 should have at least a minimum volume capacity sufficient to effect suction pickup. The required capacity may vary depending upon the size and geometry of the specific vacuum head device used, but effective capacity is generally known for available devices. Preferably, the blower 30 is of two stage design powered by a 24 volt direct current motor and delivering 66 cfm (cubic feet per minute) suction volume through a standard wide style vacuum head. The associated batteries are preferably two series connected 12 volt rechargeable batteries. Most preferably the batteries are of a deep discharge "gel" lead/acid design. Such a configuration can provide up to four hours of continuous use before recharging is required. The recharger should be one recommended for the particular battery design, but should be capable of complete recharge of the batteries within 14 hours.

The recharger should include means to electrically connect to standard alternating current power sources. Preferably, the recharger should allow connection to a standard appliance grade extension cord. This may be a standard "male" electrical connector built into the enclosure and connected to the recharger, or a male electrical "pigtail" similarly connected.

For simplicity, the switch 28 has a three-pole design. The respective three pole positions defining, alternatively, 1) an unpowered condition, 2) a powered operating condition and 3) a recharging condition. During the second, powered operating condition, power is also directed to a electric warning light 50 that is mounted to the outside of the top of the enclosure 25. The warning light provides additional safety by further alerting persons to the local hazard.

Figure 3:
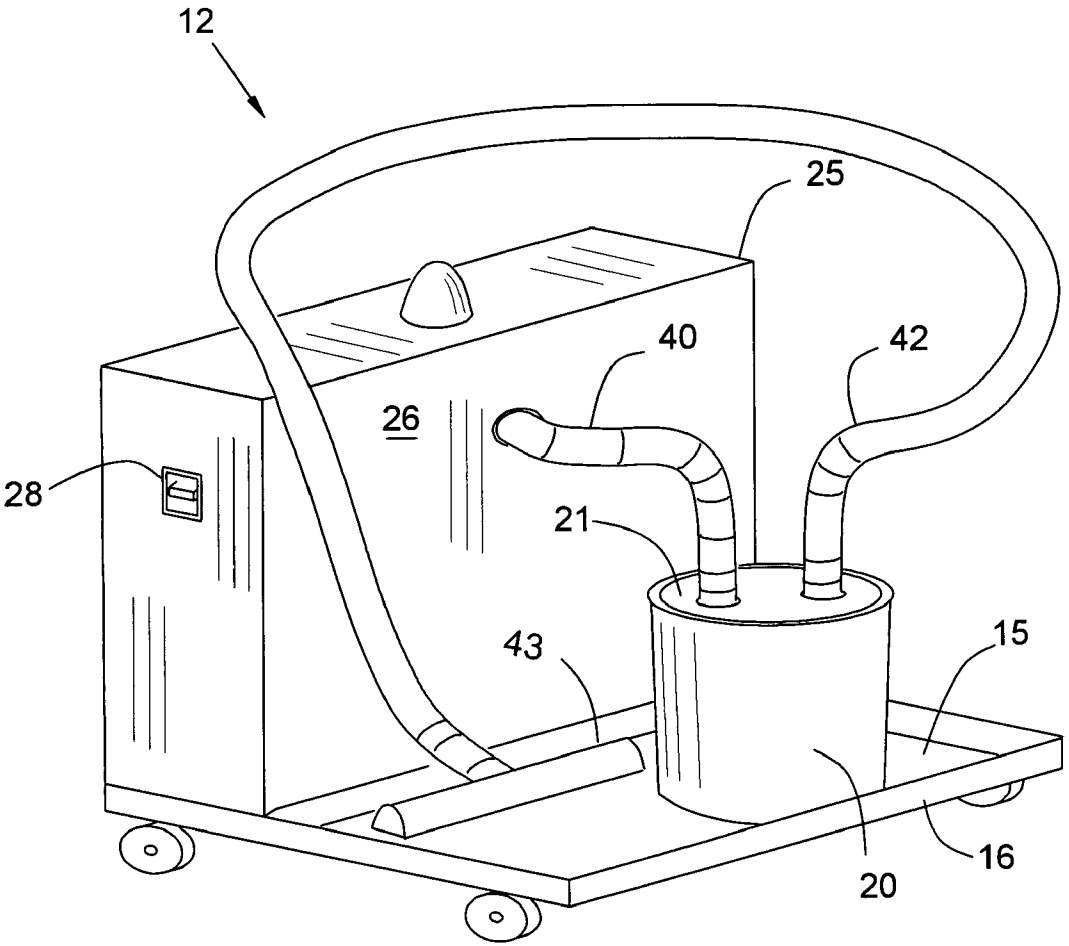
FIG. 3 depicts a storage mode of the embodiment of FIGS. 1 and 2.

The functions of the pan 15 may be provided by alternative structures such as straps, hooks or loop receptacles on the sides of the enclosure 25 to retain one or more receivers 20. However, the pan 15 illustrated provides greater benefit in providing certain protection from spills from the receiver, particularly while removing the receiver from the cart 12. In addition, the pan 15 may be used to retain and carry, in accessible manner, accessory items such as rags, cleaning solvents, and other cleaning tools. In a non-operative storage mode and configuration shown in FIG. 3, the suction hose and vacuum head 43 are retained within the pan 15 to contain any drips of liquid residue from the suction hose and vacuum head. In this manner, the wastes are completely and continuously captured within the device without risk of loss to the environment. For this reason, the pan is preferably large enough to retain at least one receiver 20 and provide space to receive the vacuum head 43.

Figure 4:
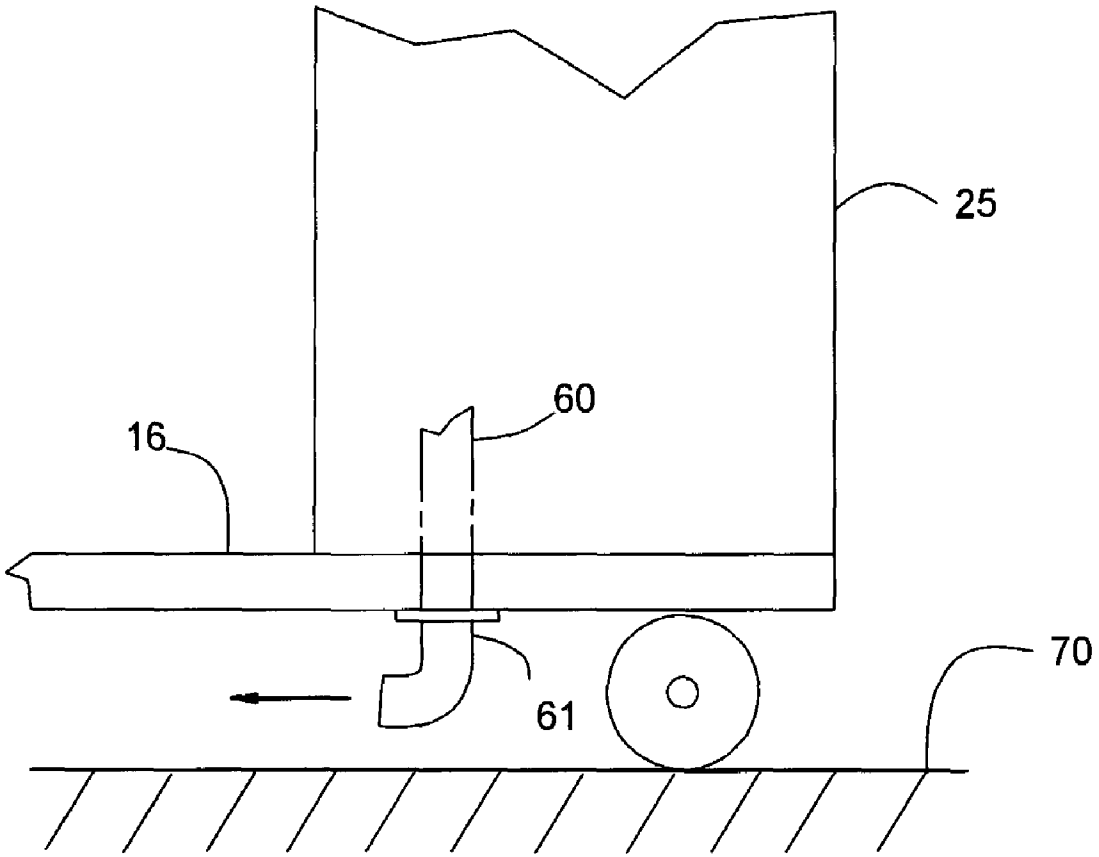
FIG. 4 depicts, in side section view, an alternative additional blower element according to the invention.

FIG. 4 illustrates an alternative embodiment of the invention in which a blower transfer hose 60 is connected to the blower outlet within the enclosure and directs the blower outlet air to a outlet port 61. The outlet port is mounted underneath the enclosure and adjacent to the supporting floor 70 which is also the working surface to be cleaned. During cleaning operations, the cart may be oriented to direct the outlet port 61 towards the working surface area to be cleaned. After suction removal of all but a film of liquid, the blown air from the outlet port dries the working surface. The outlet port 61 may have a swivel connection to allow rotating the outlet port 61 to be directed in a variety of directions. The outlet port 61 is preferably also configured to connect to a blower hose in the manner of FIG. 2.

Figure 5:
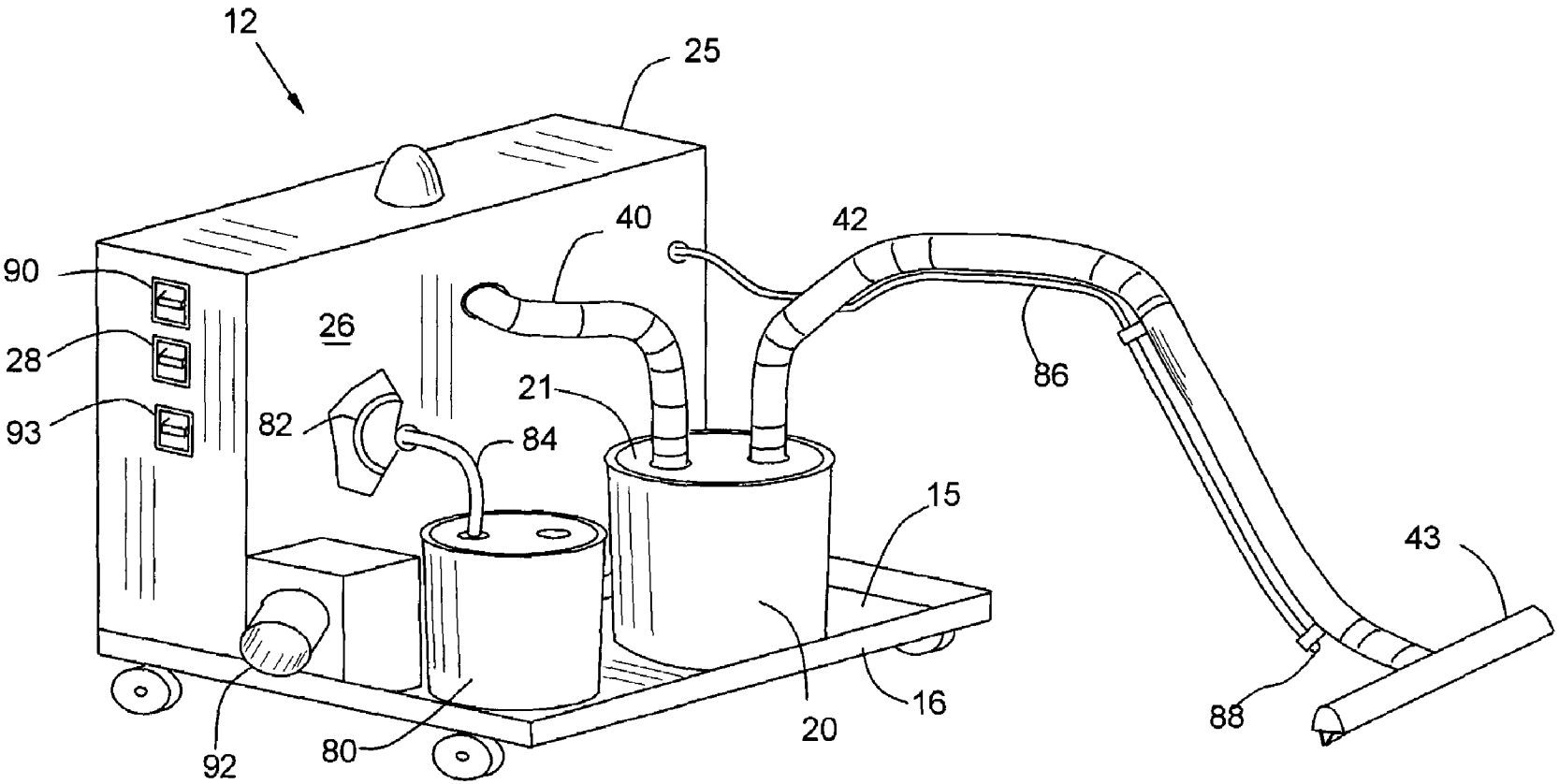
FIG. 5 depicts, in perspective view, a preferred embodiment including elements for dispensing liquid cleaning agents.

FIG. 5 depicts, in perspective view, a preferred embodiment of the invention. The embodiment includes the elements of the embodiment of FIG. 1, and the principle operation is the same. In addition, this embodiment also illustrates elements for storing and dispensing a solvent or other liquid cleaning agent. A solvent or other liquid cleaning agent such as water or a surfactant solution is retained, in use, in an agent container 80 which may take the form of a plastic or metal bucket similar to the receiver 20. An agent pump 82 draws liquid agent through a transfer hose 84 and pumps it through a dispensing tube 86 to a dispensing head 88. The dispensing head 88 is mounted on the suction hose 42 adjacent the suction head 43 and directed to dispense liquid agent on a path below the opening of the suction head. The dispensing head 88 may be a spray nozzle available currently for similar purposes. The dispensing tube 86 is preferably secured along the length of the suction hose 42 for convenience.

The agent pump 82 is electronically driven and connected through a separate control switch 90 to the batteries 29 (FIG. 1) during operation. A hand trigger control may also be provided (not shown) and such devices are currently known and available. Alternatively, the agent pump 82 may be provided in other configurations such as a submerged pump mounted within the agent container 80 to reduce potential leakage. In operation, liquid agent is dispensed on the working surface being cleaned and is vacuumed up in the same manner as waste materials. Preferably, this operation is occurs prior to blow drying to reduce the potential air-borne evaporated waste and agent. In this manner, the surrounding environment is exposure for a minimum time period to the cleaning agent and waste material. The cleaning agent is continuously stored except for the duration of use and no cleaning tools are contaminated with cleaning agent or waste material.

FIG. 5 also shows an independent option of an independent blower 92 which is also electrically powered and connected to the batteries through a second control switch 93. The exhaust of the blower 92 is directed outward and down to sweep the working surface adjacent the cart 12. This blower 92 provides the optional function of hand-free blow drying at a directed location by appropriately placing the cart 12.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A cleaning device for removing liquids from working surfaces and drying the working surface, the device comprising:

a wheeled cart body configured to be manually moved and comprising:

an enclosed housing, and a liquid-proof pan extending outward from the outside of the housing, the pan having upturned sides configured to retain liquid spills within the pan, an electrically powered vacuum blower secured within the housing the blower having an inlet and outlet;

at least one rechargeable battery secured within the housing and connectable to the blower;

a receiver for liquids removably disposed within the pan and outside the housing, the receiver connected to the blower inlet to allow air within the receiver to be drawn into the blower, the receiver also configured to be disconnected from the blower and manually removed from the pan, a flexible water-proof suction hose connected to the receiver; and a flexible blower hose connected to the blower outlet and extendable outside the housing such that the blower provides a vacuum through the suction hose to move liquid matter entrained in air through the hose to the receiver and the blower also forces the air through the blower hose to enable accelerated drying, while enabling the receiver to be separated from the cart without altering the housing for easy and simple disposal of received liquid.

2. A cleaning device according to claim 1, and wherein: the suction hose has a suction head, and the pan is configured and sized to receive and retain the suction head to enable capture of any liquid dropping from the suction head.

3. A cleaning device according to claim 2, and wherein: the batteries are configured to provide sufficient power to operate the blower for a continuous time period of 4 hours without recharging.

4. A cleaning device according to claim 2, and wherein: the body has overall horizontal orthogonal width and length dimensions of 24 and 26 inches.

5. A cleaning device according to claim 2, and further comprising a battery charger.

6. A cleaning device according to claim 2, and further comprising:

a switch mounted on the enclosure and configured to connect the battery, alternatively, to the charger and the blower.

7. A cleaning device according to claim 1, and wherein: the suction hose and blower hose each have a length of at least 72 inches.

8. A cleaning device according to claim 1, and further comprising:

means of dispensing a liquid cleaning agent proximate the suction head.

* * * * *